US006473051B2

(12) United States Patent
Mehen et al.

(10) Patent No.: US 6,473,051 B2
(45) Date of Patent: Oct. 29, 2002

(54) ELLIPTIC TO CIRCULAR POLARIZATION CONVERTER AND TEST APPARATUS INCORPORATING THE SAME FOR ACCOMMODATING LARGE AXIAL RATIO

(75) Inventors: Mike Mehen, Tucson, AZ (US); Gary Salvail, Tucson, AZ (US); Mark Kusbel, Tucson, AZ (US)

(73) Assignee: Raytheon Company, Lexington, MA (US)

( * ) Notice: Subject to any disclaimer, the term of this patent is extended or adjusted under 35 U.S.C. 154(b) by 0 days.

(21) Appl. No.: 09/804,896

(22) Filed: Mar. 13, 2001

(65) Prior Publication Data

US 2002/0130815 A1 Sep. 19, 2002

(51) Int. Cl.[7] ..... H01Q 19/00
(52) U.S. Cl. ..... 343/756; 343/909
(58) Field of Search ..... 343/708, 709, 343/710, 909, 753, 840, 916, 911 R, 756; H01Q 15/02, 19/00

(56) References Cited

U.S. PATENT DOCUMENTS 2,729,816 A * 1/1956 Crawford ..... 343/753
3,188,642 A * 6/1965 Bock et al. ..... 33/756
3,251,061 A * 5/1966 Diamond ..... 343/18
4,652,891 A * 3/1987 Bossuet et al. ..... 343/909
4,757,323 A * 7/1988 Duret et al. ..... 343/756
5,670,965 A * 9/1997 Tuovinen et al. ..... 343/703
5,673,056 A * 9/1997 Ramanujam et al. ..... 343/756
5,815,121 A * 9/1998 Collier ..... 343/756
6,188,370 B1 * 2/2001 Lange ..... 343/840
6,266,028 B1 * 7/2001 Schmidt et al. ..... 343/909

* cited by examiner

*Primary Examiner*—Don Wong
*Assistant Examiner*—Trinh Vo Dinh
(74) *Attorney, Agent, or Firm*—Renner, Otto, Boisselle & Sklar

(57) ABSTRACT

A hood is provided for verifying the performance of the missile. The hood includes one or more sense antennas having the same polarization as the antennas within the missile to be tested. The hood further includes one or more elliptic-to-circular polarization converters designed to reduce the axial ratio of the signal received from the missile. The elliptic-to-circular polarization converters convert the signal from the missile to a substantially pure circular polarized signal which is then sensed by the sense antennas.

23 Claims, 4 Drawing Sheets

ELLIPTIC TO CIRCULAR POLARIZATION CONVERTER AND TEST APPARATUS INCORPORATING THE SAME FOR ACCOMMODATING LARGE AXIAL RATIO

This invention was made with Government support under N00024-95-C5400 awarded by The Department of the Navy. The Government has certain rights in this invention.

TECHNICAL FIELD

The present invention relates generally to a polarization converter, and more particularly to a test apparatus incorporating the same.

BACKGROUND OF THE INVENTION

Military weaponry, such as missiles, oftentimes employ one or more transmitters or receivers to facilitate high frequency communications. These communications typically may be used in guiding the missile, tracking the missile, etc. In such instances, the transmitter or receiver typically includes one or more antennas for transmitting/receiving signals used in the guidance or tracking of the missile. The transmitter, receiver and antennas may be located in the nose of the missile and may communicate with guidance or tracking equipment located on the ground. Alternatively, the transmitter, receiver and antennas may communicate to engage a target, etc.

The antennas may be linear or circular polarized, for example. However, circular polarized antennas are oftentimes preferred. A circular polarized communication signal and antenna tend to be less susceptible to interference from reflections due to ground clutter, etc.

In view of the critical nature of such missile communications for guiding, tracking, etc., it is very important that the missile communications operate as intended. Consequently, "hoods" have been used extensively to verify the performance of the antennas, transmitters, receivers, cables, etc. that have been installed in the missile. For example, a hood is placed around the missile body and the power radiated from the antenna within the missile is detected by the hood and compared to a standard to determine if the hardware is functioning properly.

A problem arises, however, when the antenna within the missile is circularly polarized yet has a less than perfect axial ratio. An imperfect axial ratio can create large variations in the power sensed by the hood. Such variations are further increased by the fact that the hood is typically working in the near field of the antenna being tested. Variations in the radiated power levels sensed by the hood could often be 10 decibels (db) or more. These variations could be sufficient to mask a faulty antenna, transmitter and/or cable within the missile.

Consequently, it was difficult in the past to determine with certainty if an alarming variation in the radiated power sensed by the hood was due simply to a less than perfect axial ratio, or instead faulty hardware within the missile. Large variations had to be resolved by disassembling the missile and testing the antenna, transmitter, cables, etc. individually. This was quite time consuming and expensive as it required a significant number of skilled man-hours. Even if the antenna, transmitter, cables, etc. were tested individually prior to assembly within the missile, there still would be uncertainty as to whether there was damage or failure during installation in the missile.

In view of the aforementioned shortcomings associated with testing the missiles, there is a strong need for an apparatus which overcomes the problems associated with large axial ratios. More specifically, there is a strong need for a hood apparatus which can verify with certainty if the installed antenna, transmitter, cables, etc. are functioning properly even in the event of a large axial ratio. There is a strong need for such a hood apparatus which provides such verification so as to eliminate the need to disassemble the missile in order to test the components individually.

SUMMARY OF THE INVENTION

In accordance with the invention, a hood is provided for verifying the performance of a missile. The hood includes one or more sense antennas having the same polarization as the antennas within the missile to be tested. The hood further includes one or more elliptic-to-circular polarization converters designed to reduce the axial ratio of the signal received from missile. The elliptic-to-circular polarization converters convert the signal from the missile to a substantially pure circular polarized signal which is then sensed by the sense antennas. This eliminates the uncertainty associated with conventional hoods as to whether variations in the sensed signal are due to imperfect axial ratio or a failure of one or more components within the missile.

According to one particular aspect of the invention, an elliptic-to-circular polarization converter is provided for converting an elliptically polarized signal traveling along a propagation path into a circularly polarized signal. The converter includes a grating including electrically conductive members arranged to separate a linear component associated with the elliptically polarized signal from a circular component associated with the elliptically polarized signal, and to allow the circular component to travel through the grating along the propagation path while blocking travel of the linear component along the propagation path.

According to another aspect of the invention, a test apparatus is provided for evaluating a signal source with potentially a large axial ratio. The test apparatus includes an elliptic-to-circular polarization converter for converting an elliptically polarized signal traveling along a propagation path, from the signal source, into a circularly polarized signal, the elliptic-to-circular polarization converter including a grating including electrically conductive members arranged to separate a linear component associated with the elliptically polarized signal from a circular component associated with the elliptically polarized signal, and to allow the circular component to travel through the grating along the propagation path while blocking travel of the linear component along the propagation path. The test apparatus further includes a sense antenna for receiving at least part of the circular component allowed to travel through the grating along the propagation path.

In accordance with yet another aspect of the invention, a missile hood for evaluating a signal source within a missile is provided. The missile hood includes an elliptic-to-circular polarization converter for converting an elliptically polarized signal traveling along a propagation path, from the signal source, into a circularly polarized signal. The elliptic-to-circular polarization converter includes a grating including electrically conductive members arranged to separate a linear component associated with the elliptically polarized signal from a circular component associated with the elliptically polarized signal, and to allow the circular component to travel through the grating along the propagation path while blocking travel of the linear component along the propagation path. The missile hood further includes a sense antenna for receiving at least part of the circular component allowed to travel through the grating along the propagation path; and an annular housing assembly fittable over a body of the missile for holding the grating and the sense antenna in fixed series relation along the propagation path relative to the signal source.

To the accomplishment of the foregoing and related ends, the invention, then, comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

DESCRIPTION OF THE PREFERRED EMBODIMENT

Figure 1:
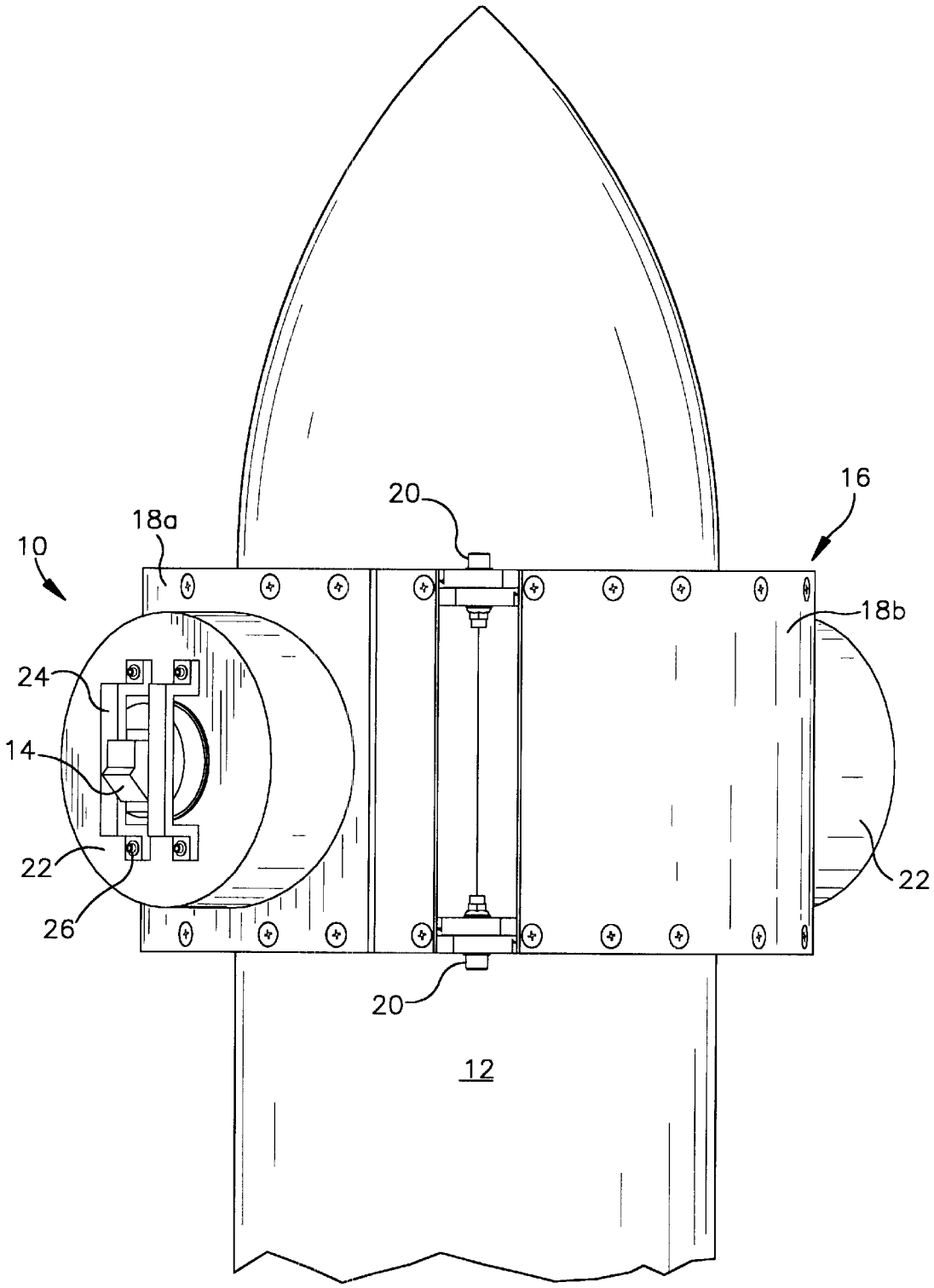
FIG. 1 is a schematic view of a hood placed on a missile for verifying the performance of the missile in accordance with the present invention.

The present invention will now be described with reference to the figures, wherein like reference numerals are used to refer to like elements throughout.

Referring initially to FIG. 1, a hood 10 is shown in accordance with the present invention. During use, the hood 10 is placed around the body of a missile 12 as shown in FIG. 1. As will be described in more detail below in connection with FIG. 2, the hood 10 includes one or more sense antennas 14 for sensing the power of a signal transmitted from within the missile 12. The sense antennas 14 are positioned within the hood 10 along the propagation path of the signal transmitted from the missile 12.

The hood 10 further includes one or more elliptic-to-circular polarization converters (not shown in FIG. 1). The signal transmitted from the missile 12 is designed ideally to be circularly polarized (e.g., right hand circular or left hand circular), and the sense antennas 14 are of the same polarization. For various reasons independent of failure of the components in the missile 12, however, the signal transmitted from the missile 12 may have less than an ideal axial ratio. Thus, the signal transmitted from the missile 12 may in fact be elliptically polarized. The elliptic-to-circular polarization converters function to convert the signal transmitted from the missile 12 to a substantially purely circular polarized signal which is then received by the sense antennas 14. As a result, variations in the power level of the signal received by the sense antennas 14 are no longer based on a large axial ratio and instead may be knowingly attributed to component failure in the missile 12 hardware (e.g., antenna, transmitter, cables, etc.).

Continuing to refer to FIG. 1, the hood 10 includes an annular shaped housing 16 designed to fit around the body of the missile 12. The hood 10 typically is positioned on the missile 12 at a location (e.g., the nose) adjacent the antenna or antennas (not shown) located within the missile 12. In the exemplary embodiment, the housing 16 includes respective semicircular half frames 18*a* and 18*b*. The half frames 18*a* and 18*b* are hinged together at one end by hinge bolts 20. This permits the hood 10 to be opened up in order to be placed around the missile 12 and then closed in order to fit around the complete circumference of the missile 12. The half frames 18*a* and 18*b* may be made of any suitable shroud material, for example, and may be filled with absorber (not shown) to eliminate undesirable reflections as will be appreciated.

Figure 2:
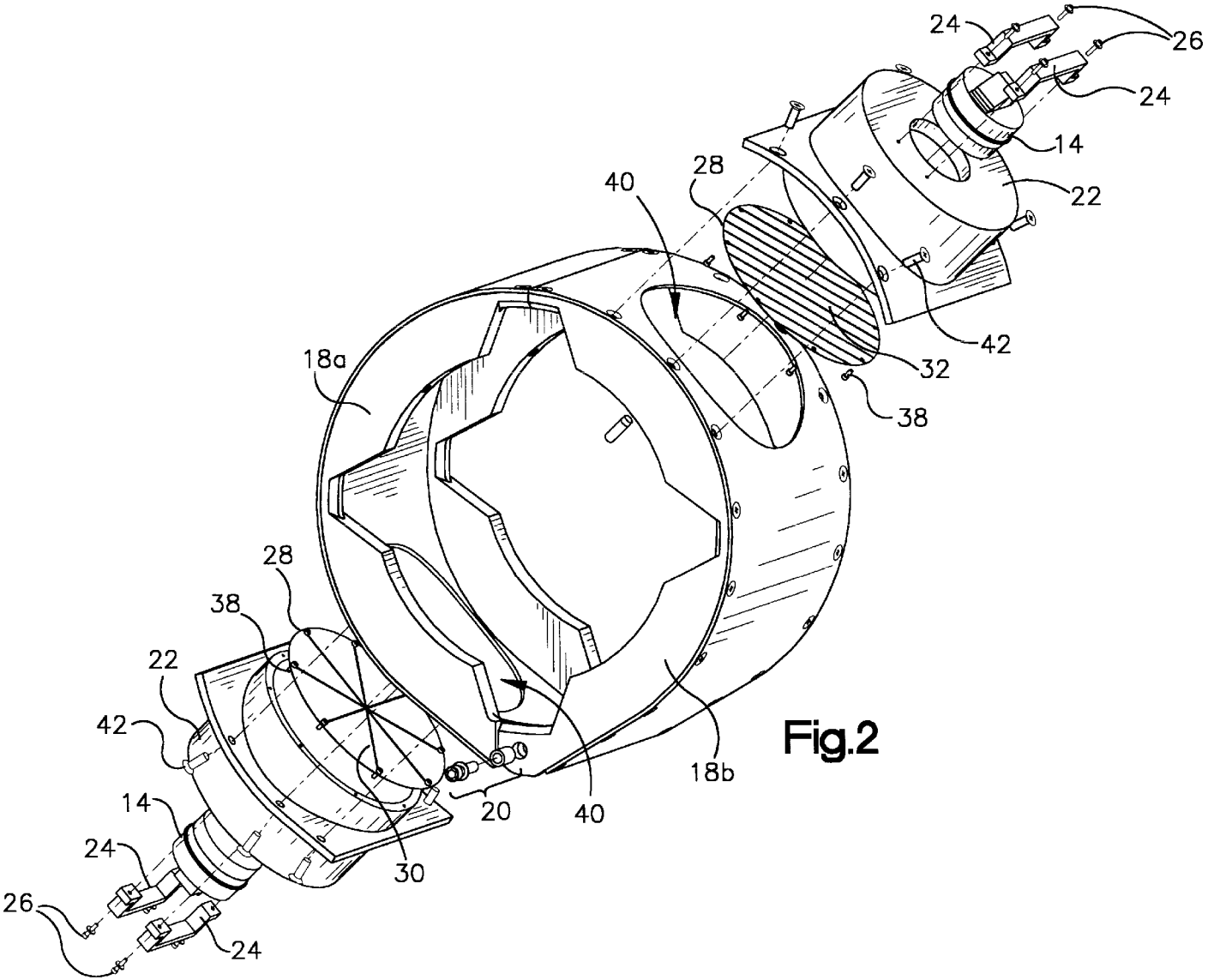
FIG. 2 is an exploded view of a hood with elliptic-to-circular polarization converters in accordance with the present invention.

Referring now to FIG. 2, an exploded view of the hood 10 is provided. In the exemplary embodiment, the hood 10 includes two sense antennas 14 mounted diametrically opposite one another and directed radially inward. It will be appreciated, however, that any number of sense antennas 14 may be utilized without departing from the scope of the invention.

In the exemplary embodiment, each sense antenna 14 is a circularly polarized broadband spiral antenna. The orientation of the sense antenna 14 (e.g., right-hand vs. left-hand) is designed to be the same as the signal which is to be transmitted from the missile 12. Each sense antenna 14 is secured to a respective antenna mount 22 via a set of clamping straps 24 secured by fasteners 26.

Each antenna mount 22 has a generally cylindrical shape with a sense antenna 14 located at one end of the cylinder. Located at the other end of each cylinder is an elliptic-to-circular polarization converter and enhancement grating panel 28. As will be described in more detail in relation to FIGS. 3 and 4, the panel 28 is made of a low-dielectric substrate such as Duroid. The panel 28 includes an elliptic-to-circular polarization converter 30 which serves to remove a linear component of an elliptically polarized signal transmitted from within the missile 12 before it reaches the sense antenna 14. As a result, the signal which is received by the sense antenna 14 is purely circularly polarized as desired. The elliptic-to-circular polarization converter in the exemplary embodiment is formed by a radial configuration of electrically conductive traces representing a grating on the panel 28, although it will be appreciated that other patterns may also be suitable.

Each panel 28 further includes an enhancement grating 32 formed on an opposite surface of the low-dielectric substrate. The inventors have found empirically that the inclusion of the enhancement grating 32 between the elliptic-to-to-circular polarization converter 30 and the sense antenna 14 further improves the axial ratio of the signal as received by the sense antenna 14. The enhancement grating 32 in the exemplary embodiment is made up of a series of electrically conductive parallel traces, although it will be further appreciated that other patterns again may also be suitable.

Each elliptic-to-circular polarization converter and enhancement grating panel 28 is secured to an annular opening at the end of the respective cylindrical shaped antenna mount 22 opposite the sense antenna 14 via nylon fasteners 38 or the like. An electrically conductive outer ring (not shown) or some other means is provided for electrically coupling the conductive traces of the elliptic-to-circular polarization converter 30 and the enhancement grating 32 as mounted to the antenna mount 22 to the relative ground of the respective sense antenna 14. Each antenna mount 22 is then secured to the housing 16 in a respective aperture 40 via fasteners 42.

Figure 3:
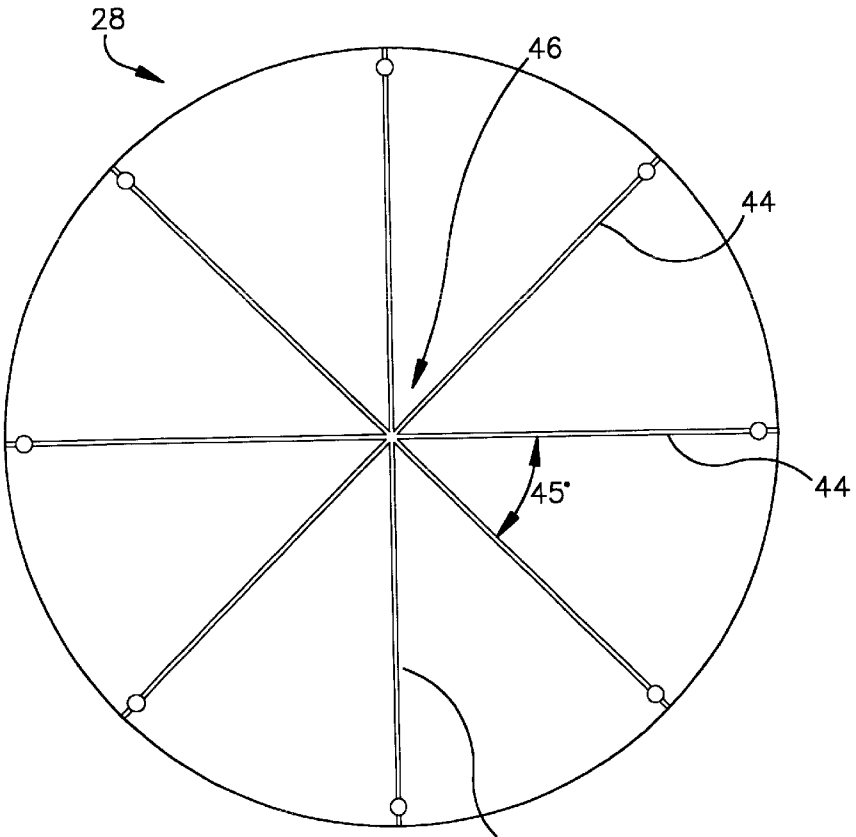
FIG. 3 is a plan view of an elliptic-to-circular polarization converter having a radial grating in accordance with the present invention.

Turning to FIG. 3, the elliptic-to-circular polarization converter 30 formed on one surface of the panel 28 is shown. As noted above, the converter 30 includes a grating made up of a series of eight spoke-like traces 44 evenly spaced apart at 45° and extending radially outward from a central point 46. The central point 46 is located to within the antenna mount 22 so as to lie along the propagation axis of the signal transmitted from the missile 12. The traces 44 are formed of an electrically conductive material such as metal. For example, the traces 44 may be formed of copper which is deposited and/or patterned and etched on the substrate making up the panel 28.

Figure 4:
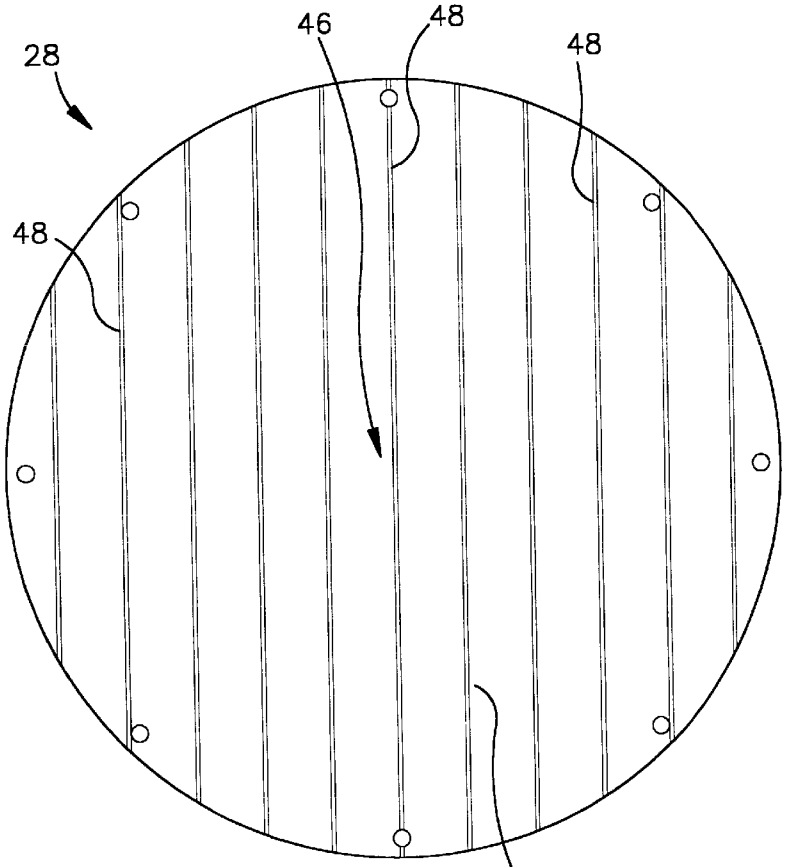
FIG. 4 is a plan view of an enhancement grating in accordance with the present invention.

FIG. 4 illustrates the enhancement grating 32 formed on the opposite surface of the panel 28. The enhancement grating 32 is formed by traces 48 arranged in parallel and made of an electrically conductive material such as metal. Again, for example, the traces 48 may be formed of copper which is deposited and/or patterned and etched on the substrate making up the panel 28. The particular position and spacing between the traces 48 may be determined empirically to obtain an optimum axial ratio (e.g., a variation in axial ratio of less than 1 db). In another embodiment, the enhancement grating 32 may be formed of a grid pattern of traces 48 with two sets of parallel traces orthogonal to each other.

Figure 5:
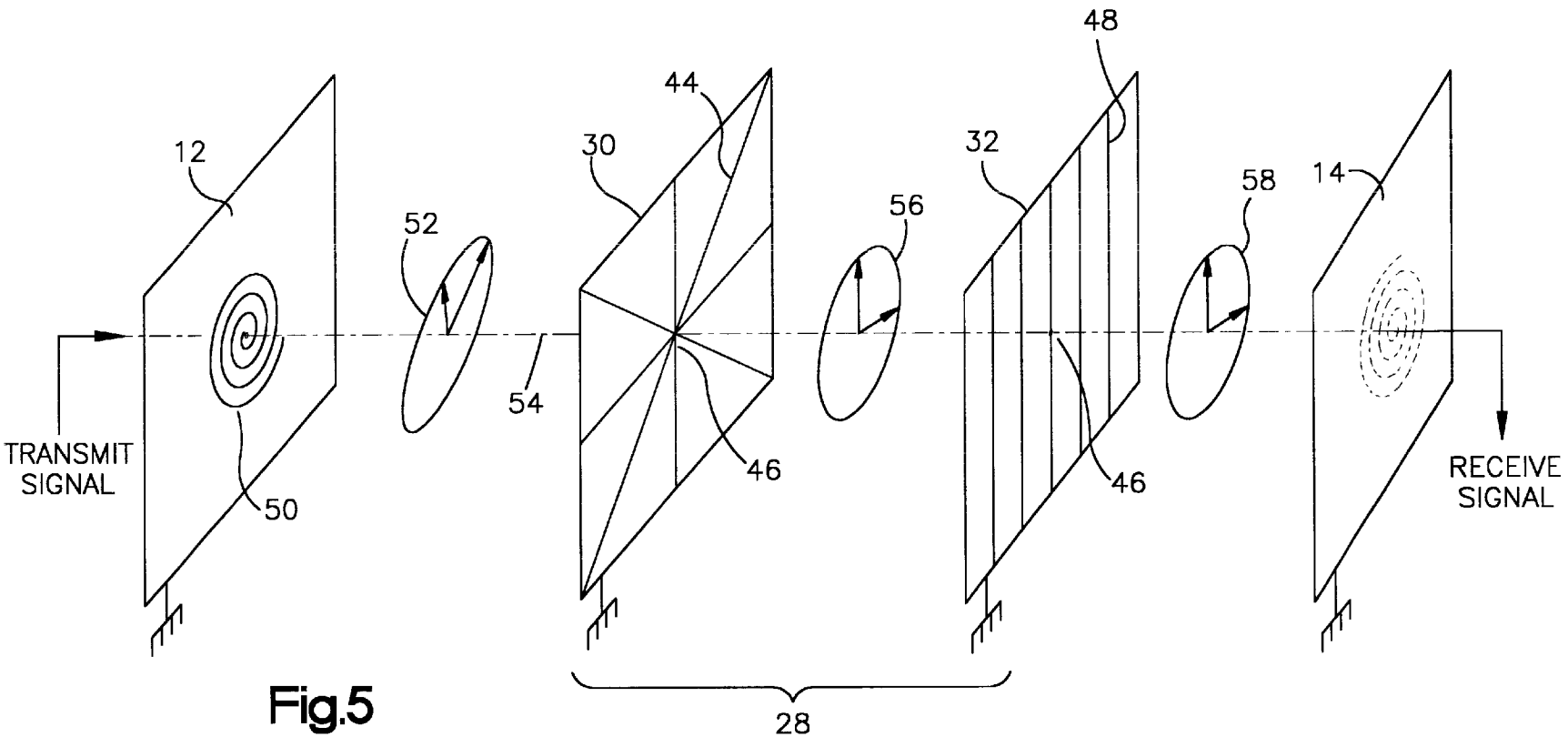
FIG. 5 is a schematic representation of elliptic-to-circular polarization in accordance with the present invention.

FIG. 5 illustrates schematically the operation of the hood 10 with the elliptic-to-to-circular polarization converter and enhancement grating panel 28 in accordance with the present invention. A signal is caused to be transmitted from the missile 12 via an antenna 50 located within the missile 12. The antenna 50 is a circularly polarized antenna which transmits the signal as an elliptically polarized signal 52 along a propagation path 54. The elliptic-to-circular polarization converter 30 with its grating traces 44 spaced at 45° intervals functions to separate a linear component associated with the elliptically polarized signal from a circular component associated with the elliptically polarized signal. The linear component is separated and shorted to relative ground to which the traces 44 are coupled. As a result, the elliptic-to-circular polarization converter allows the circular component 56 to travel through the grating of the converter 30 along the propagation path 54 while blocking travel of the linear component along the propagation path 54.

The circularly polarized signal 56 next passes through the enhancement grating 32. The enhancement grating 32 is also coupled to relative ground and serves to further improve the axial ratio of the signal to produce circularly polarized signal 58 with further improved axial ratio. As will be appreciated, the enhancement grating 32 is not a necessary feature of the invention in its broadest sense and may be omitted. However, the inventors have found empirically that the provision of the enhancement grating 32 further improves the axial ratio of the resultant circularly polarized signal 58.

The sense antenna 14 receives the circularly polarized signal 58 and the signal level is measured in accordance with a predefined criteria. Based on such signal level, it is possible to ascertain whether the components (e.g., antenna 50, transmitter, cables, etc.) within the missile 12 are functioning properly.

It will be appreciated that the elliptic-to-circular polarization converter described herein in connection with a missile hood may be useful in other types of test apparatuses or devices. Thus, while the elliptic-to-circular polarization converter described herein has particular utility in a missile hood it will be appreciated that the invention in its broadest sense may have use in other converter applications and test apparatuses. Accordingly, the present invention is intended to include such converters and apparatuses.

Although the invention has been shown and described with respect to certain preferred embodiments, it is obvious that equivalents and modifications will occur to others skilled in the art upon the reading and understanding of the specification. For example, the elliptic-to-circular polarization converter grating 30 and enhancement grating 32 need not be formed on the same substrate. Additionally, such gratings may be formed as self-supporting structures (i.e., without a supporting substrate), as will be appreciated. The present invention includes all such equivalents and modifications, and is limited only by the scope of the following claims.

What is claimed is:

1. An elliptic-to-circular polarization converter for converting an elliptically polarized signal traveling along a propagation path into a circularly polarized signal, comprising:

a grating including electrically conductive members arranged to separate a linear component associated with the elliptically polarized signal from a circular component associated with the elliptically polarized signal, and to allow the circular component to travel through the grating along the propagation path while blocking travel of the linear component along the propagation path, wherein the electrically conductive members extend radially from a common central point and are spaced relative to one another in 45° increments.

2. The polarization converter of claim 1, wherein the grating comprises a low dielectric substrate having the electrically conductive members formed thereon.

3. The polarization converter of claim 2, wherein the electrically conductive members comprise metal traces formed on the low dielectric substrate.

4. The polarization converter of claim 1, further comprising an enhancement grating adjacent the grating and including a plurality of linear electrically conductive members arranged in parallel.

5. The polarization converter of claim 4, wherein the enhancement grating comprises a low dielectric substrate having the linear electrically conductive members formed thereon.

6. The polarization converter of claim 5, wherein the linear electrically conductive members comprise metal traces formed on the low dielectric substrate.

7. An elliptic-to-circular polarization converter for converting an elliptically polarized signal traveling along a propagation path into a circularly polarized signal, comprising:

a grating including electrically conductive members arranged to separate a linear component associated with the elliptically polarized signal from a circular component associated with the elliptically polarized signal, and to allow the circular component to travel through the grating along the propagation path while blocking travel of the linear component along the propagation path; and an enhancement grating adjacent the grating and including a plurality of linear electrically conductive members arranged in parallel, wherein the enhancement grating comprises a low dielectric substrate having the linear electrically conductive members formed thereon, the linear electrically conductive members comprise metal traces formed on the low dielectric substrate, and the linear electrically conductive members are formed on one surface of the low dielectric substrate and the electrically conductive members are formed on an opposite surface of the low dielectric substrate.

8. A test apparatus for evaluating a signal source with potentially a large axial ratio, comprising:

an elliptic-to-circular polarization converter for converting an elliptically polarized signal traveling along a propagation path, from the signal source, into a circularly polarized signal, the elliptic-to-circular polarization converter comprising a grating including electrically conductive members arranged to separate a linear component associated with the elliptically polarized signal from a circular component associated with the elliptically polarized signal, and to allow the circular component to travel through the grating along the propagation path while blocking travel of the linear component along the propagation path; and a sense antenna for receiving at least part of the circular component allowed to travel through the grating along the propagation path, wherein the electrically conductive members extend radially from a common central point and are spaced relative to one another in 45° increments.

9. The test apparatus of claim 8, wherein the grating comprises a low dielectric substrate having the electrically conductive members formed thereon.

10. The test apparatus of claim 9, wherein the electrically conductive members comprise metal traces formed on the low dielectric substrate.

11. The test apparatus of claim 8, further comprising an enhancement grating adjacent the grating and including a plurality of linear electrically conductive members arranged in parallel.

12. The test apparatus of claim 11, wherein the enhancement grating comprises a low dielectric substrate having the linear electrically conductive members formed thereon.

13. The test apparatus of claim 12, wherein the linear electrically conductive members comprise metal traces formed on the low dielectric substrate.

14. The test apparatus of claim 8, further comprising housing assembly for holding the grating and a source antenna in fixed series relation along the propagation path relative to the signal source.

15. A test apparatus for evaluating a signal source with potentially a large axial ratio, comprising:

an elliptic-to-circular polarization converter for converting an elliptically polarized signal traveling along a propagation path, from the signal source, into a circularly polarized signal, the elliptic-to-circular polarization converter comprising a grating including electrically conductive members arranged to separate a linear component associated with the elliptically polarized signal from a circular component associated with the elliptically polarized signal, and to allow the circular component to travel through the grating along the propagation path while blocking travel of the linear component along the propagation path;

a sense antenna for receiving at least part of the circular component allowed to travel through the grating along the propagation path; and an enhancement grating adjacent the grating and including a plurality of linear electrically conductive members arranged in parallel, wherein the enhancement grating comprises a low dielectric substrate having the linear electrically conductive members formed thereon, the linear electrically conductive members comprise metal traces formed on the low dielectric substrate, and the linear electrically conductive members are formed on one surface of the low dielectric substrate and the electrically conductive members are formed on an opposite surface of the low dielectric substrate.

16. A missile hood for evaluating a signal source within a missile, comprising:

an elliptic-to-circular polarization converter for converting an elliptically polarized signal traveling along a propagation path, from the signal source, into a circularly polarized signal, the elliptic-to-circular polarization converter comprising a grating including electrically conductive members arranged to separate a linear component associated with the elliptically polarized signal from a circular component associated with the elliptically polarized signal, and to allow the circular component to travel through the grating along the propagation path while blocking travel of the linear component along the propagation path;

a sense antenna for receiving at least part of the circular component allowed to travel through the grating along the propagation path; and an annular housing assembly fittable over a body of the missile for holding the grating and the sense antenna in fixed series relation along the propagation path relative to the signal source, wherein the electrically conductive members extend radially from a common central point and are spaced relative to one another in 45° increments.

17. The missile hood of claim 16, wherein the grating comprises a low dielectric substrate having the electrically conductive members formed thereon.

18. The missile hood of claim 17, wherein the electrically conductive members comprise metal traces formed on the low dielectric substrate.

19. The missile hood of claim 16, further comprising an enhancement grating adjacent the grating and including a plurality of linear electrically conductive members arranged in parallel.

20. The missile hood of claim 19, wherein the enhancement grating comprises a low dielectric substrate having the linear electrically conductive members formed thereon.

21. The missile hood of claim 20, wherein the linear electrically conductive members comprise metal traces formed on the low dielectric substrate.

22. The missile hood of claim 16, comprising a plurality of sense antennas and gratings held in series along respective propagation paths.

23. A missile hood for evaluating a signal source within a missile, comprising:

an elliptic-to-circular polarization converter for converting an elliptically polarized signal traveling along a propagation path, from the signal source, into a circularly polarized signal, the elliptic-to-circular polarization converter comprising a grating including electrically conductive members arranged to separate a linear component associated with the elliptically polarized signal from a circular component associated with the elliptically polarized signal, and to allow the circular component to travel through the grating, along the propagation path while blocking travel of the linear component along the propagation path;

a sense antenna for receiving at least part of the circular component allowed to travel through the grating along the propagation path;

an annular housing assembly fittable over a body of the missile for holding the grating and the sense antenna in fixed series relation along the propagation path relative to the signal source; and an enhancement grating adjacent the grating and including a plurality of linear electrically conductive members arranged in parallel, wherein the enhancement grating comprises a low dielectric substrate having the linear electrically conductive members formed thereon, the linear electrically conductive members comprise metal traces formed on the low dielectric substrate, and the linear electrically conductive members are formed on one surface of the low dielectric substrate and the electrically conductive members are formed on an opposite surface of the low dielectric substrate.

* * * * *